United States Patent [19]

Johnsen

[11] Patent Number: 5,060,493

[45] Date of Patent: Oct. 29, 1991

[54] SINGLE UNIT KEY ACTIVATED PIN LOCK

[76] Inventor: Thore Johnsen, 2976 Islip Ct., Wantagh, N.Y. 11793

[21] Appl. No.: 533,575

[22] Filed: Jun. 5, 1990

[51] Int. Cl.[5] ..... E05B 65/08

[52] U.S. Cl. ..... 70/95; 70/100; 70/360

[58] Field of Search ..... 70/360, 361, 99, 100, 70/81, 90, 89, 95

[56] References Cited

U.S. PATENT DOCUMENTS

| | | | |
|---|---|---|---|
| 3,071,958 | 1/1963 | Russo | 70/361 |
| 3,078,704 | 2/1963 | Rifkin | 70/90 |
| 3,345,838 | 10/1967 | Russell | 70/360 |
| 3,455,128 | 7/1969 | Tenkoff | 70/301 |
| 3,668,906 | 6/1972 | Josephart | 70/90 |
| 3,726,115 | 4/1973 | Wellekens | 70/361 |
| 3,744,283 | 7/1973 | Schmidt | 70/90 |
| 4,565,080 | 1/1986 | Kincaid | 70/361 |
| 4,768,360 | 9/1988 | Foshee | 70/100 |

*Primary Examiner*—Robert L. Wolfe

*Attorney, Agent, or Firm*—Ladas & Parry

[57] ABSTRACT

A pin lock device which can be permanently attached to the frame of a sliding curtain shutter type door. The pin lock device has a rigid body with a bore which may be attached to the frame of the shutter type door. A bolt located in the bore is movable between first and second positions in the bore, but cannot be completely withdrawn. The bolt can be immobilized in the locked position in the rigid body, thereby allowing the sliding shutter door to be locked, and is restrained from being fully withdrawn in the unlocked position to allow the bolt to be safe from loss or tampering when the sliding shutter door is opened.

12 Claims, 5 Drawing Sheets

SINGLE UNIT KEY ACTIVATED PIN LOCK

BACKGROUND OF THE INVENTION

1. Field Of The Invention

This invention pertains to the field of locks, and more particularly to pin locks used to lock sliding shutter type doors.

BACKGROUND OF THE INVENTION

2. Description Of the Prior Art

Locking devices for use with sliding curtain shutter type doors have long been well known in the art. Sliding curtain shutter type doors have mainly been secured by one of three types of locks, each type requiring a hole to be drilled in the door track in which the curtain shutter slides, and a corresponding hole drilled in the curtain shutter and in alignment with the door track hole when the curtain shutter is in the closed position. In the first type of lock, a hasp having a hole is welded adjacent to the hole in the door track. A pin lock with another hasp on one end is then inserted into the hole through the door track, through the curtain shutter, and out the back side of the track. When the pin lock is in place, both hasps line up and a conventional padlock couples the two together. In a second locking device, a removable pin lock having a rotating locking member located at the end of a shaft opposite the keyed end is inserted through the hole in the door frame and sliding shutter, and the rotating locking member is rotated in relation to the shaft, thus immobilizing the pin lock in the hole through the door frame and curtain shutter. A third type of pinlock, disclosed in Forman, U.S. Pat. No. 3,600,912, has a male threaded end which engages with a female thread on the door frame.

The procedure for unlocking sliding curtain shutter doors utilizing the first type of lock is to (1) unlock the padlock, (2) remove the padlock from the holes in the hasp and lock, and (3) remove the pin lock. The procedure for unlocking a sliding curtain shutter door which utilizes the second type of locking device is to (1) unlock the pinlock, and (2) remove the pin lock, and the procedure to open a sliding curtain shutter door which utilizes the third type of lock is to (1) unlock the pin lock and (2) unscrew it from the threaded portion located on the door track behind the shutter door, and (3) remove the pin lock. The reversed procedure would be followed upon locking the sliding shutter doors. In each case, the padlocks and pin locks would normally be set aside in order to enable the operator to move the shutter door.

A major practical problem associated with the use of the above described pin locks arises from the fact that in each case, the padlocks and/or pin locks must be completely removed from the door frame and set aside, with the result that the padlocks and/or pin locks are often misplaced, stolen, or tampered with. The present invention is a single unit key activated pin lock which overcomes these problems.

SUMMARY OF THE INVENTION

The present invention provides an improved, self-contained, single unit key activated pin lock (hereinafter "pin lock") having a rigid body which is permanently attached to the door frame of a sliding curtain shutter door having a hole drilled therethrough, and a bolt which slides within a bore in the rigid body and which can be immobilized in a locking position, but which cannot be completely disengaged from the rigid body. The sliding curtain shutter door has a hole drilled therethrough which aligns with the hole drilled in the door frame, through which the bolt slides thereby locking the sliding curtain shutter door. Since there are no free pieces of the pin lock which can be misplaced, stolen or tampered with, and since the locking and unlocking procedure can be easily accomplished with a single hand, the opening and closing routine is greatly simplified.

BRIEF DESCRIPTION OF THE DRAWINGS

In describing the invention, reference will be made to the accompanying drawings wherein.

DETAILED DESCRIPTION OF THE PREFERRED EMBODIMENTS

In FIGS. 1-17 there are illustrated five embodiments of the pin lock. Within these embodiments, there are numerous shared elements and features, which are indicated with the same numbering.

Figure 2:
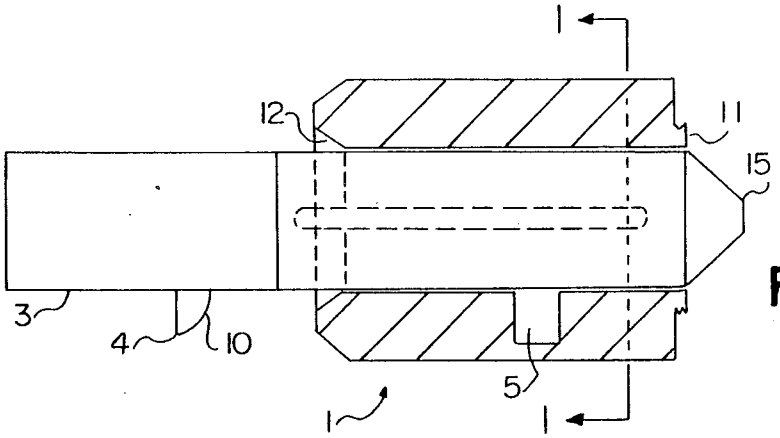
FIGS. 2 and 3 are partial longitudinal cross-sectional views of the first embodiment of the invention with its bolt in first and second positions, respectively.
Figure 3:
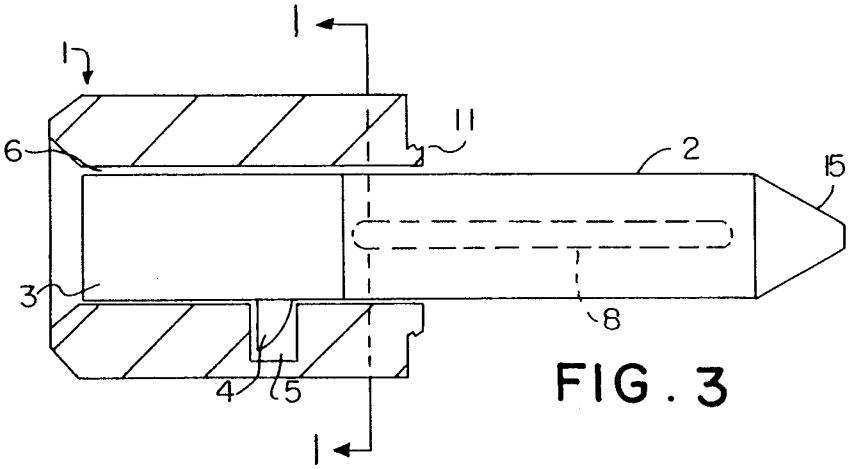
Figure 1:
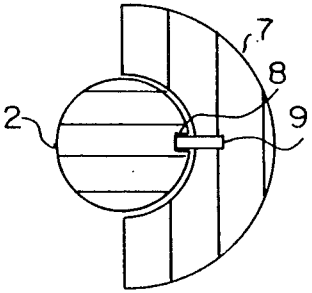
FIG. 1 is a partial cross-sectional view of the first embodiment of the invention taken along the lines 1—1 in FIGS. 2 and 3.

In FIGS. 1-3, the first embodiment of the pin lock 1 is illustrated. FIG. 1 is a partial cross-sectional view of the pin lock 1 taken along view line 1—1 in FIGS. 2 and 3. FIGS. 2 and 3 are partial longitudinal cross-sections of the pin lock 1 in an unlocked first position and a locked second position, respectively. The pin lock 1 has a bolt 2, and a cylinder lock 3 having tumblers (not shown) mounted on one end of the bolt 2. The cylinder lock 3 has a latch member 4 which has a beveled face 10. The latch member 4 is spring loaded (not shown) in the cylinder lock 3 which allows the latch member 4 to be withdrawn into the cylinder lock 3 as the bolt 2 and cylinder lock 3 move toward the locked position at which position latch member 4 is captured in indentation 5. When the lock cylinder 3 is activated by a key means (not shown) to unlock the pin lock, the latch member 4 is withdrawn into the cylinder lock 3 and is disengaged from indentation 5 in the bore 6, which allows the bolt 2 to be withdrawn and placed in a first unlocked position, shown in FIG. 2. The key means can only be withdrawn from the cylinder lock 3 when the latch member 4 is extended from the cylinder lock 3, so with the key means removed and the bolt 2 in the first position, the user of the pin lock 1 can push the bolt 2 along the bore 6 and lock the pin lock 1. This may be done when the sliding curtain shutter door is closed and also when the sliding curtain shutter door is opened. This feature protects the pin lock 1 from tampering. In the locked position, the latch member 4 locks in place in the indentation 5 lying inside the bore 6 of the rigid body 7. The bolt 2 has a recessed groove 8 in which a pin 9 slides, which prevents the bolt 2 from being moved beyond a first, fully unlocked position. Pin 9 can be disengaged from slot 8 so that bolt 2 may be completely removed from the bore 6 in the rigid body 7. The end of the bolt 2 is beveled at its end 15 opposite the end having the cylinder lock 3, which helps guide the bolt 2 into a hole in the door frame (not shown) and shutter door (not shown). The end of the rigid body 7 opposite the end closest to the cylinder lock has a raised shoulder 11 which can be used either to align the pin lock with the hole in the door frame for welding purposes and/or can be threaded so that the pin lock can be attached to the shutter door frame with a nut. If the pin lock is to be attached to the door frame by a nut, then obviously the shoulder would be longer and threaded. At the end of the bore 6 in the rigid body 7, opposite the raised shoulder 11, there is a bevel 12 on the inside of the bore 6 which aids in pushing the lock member 4 into the cylinder lock 3 when the bolt 2 is pushed into the bore 6 from the unlocked position, shown in FIG. 2, and into the locked position shown in FIG. 3. In this embodiment, the combination of the recessed groove 8 and the pin 9 not only limit longitudinal movement of the bolt 2 in the bore 6, but also limit rotation of the bolt 2 in the bore 6. In this embodiment, the bolt can have almost any cross-sectional geometry.

Figure 5:
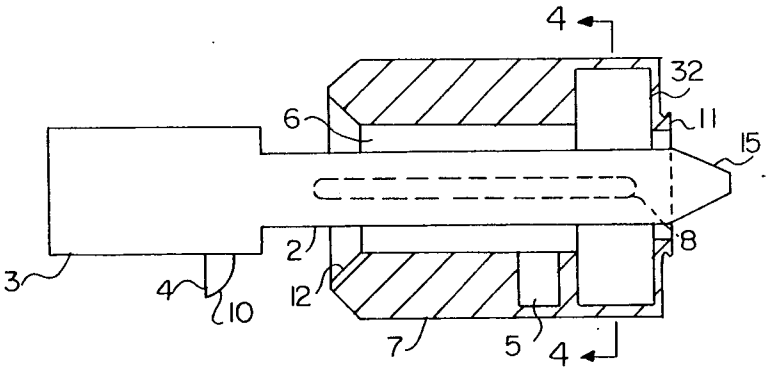
FIGS. 5 and 6 are partial longitudinal cross-sectional views of the second embodiment of the invention with its bolt in first and second positions, respectively.
Figure 4:
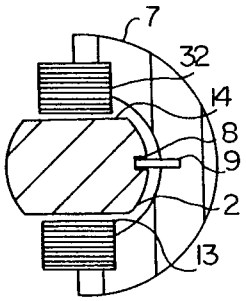
FIG. 4 is a partial cross-sectional views of a second embodiment of the invention taken along the lines 4—4 in FIGS. 5 and 6.
Figure 6:
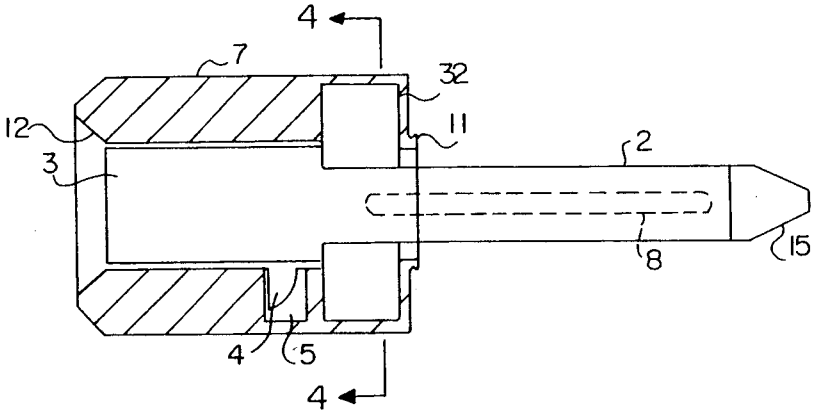

The second embodiment of the pin lock 1, shown in FIGS. 4–6, is similar to the first embodiment shown in FIGS. 1–3 except as noted below. FIG. 4 is a partial cross-sectional view taken along line 4—4 in FIGS. 5 and 6. Protrusions 32, having facial surfaces 13, are located inside the rigid body 7 and extend into the bore 6. Facial surfaces 13 slidably engage with a corresponding facial surface on the bolt 14, thus preventing the bolt 6 from rotating within the bore 6. The other elements of the second embodiment remain the same as in the first embodiment. FIG. 5 illustrates the pin lock 1 in a unlocked position while FIG. 6 shows the pin lock 2 in a locked position, both FIGS. 5 and 6 being partial longitudinal cross-sectional views. Although not shown, protrusion 32 may be spring loaded in the rigid body.

Figure 8:
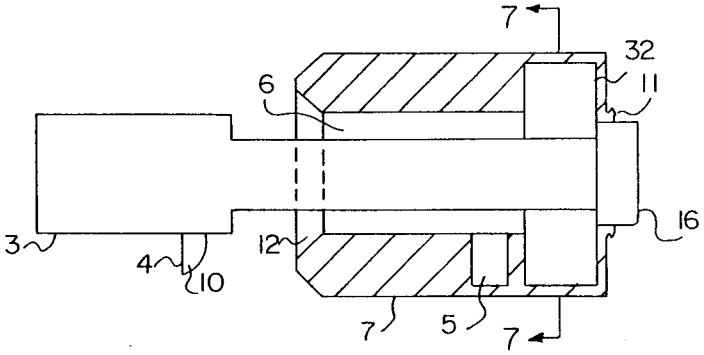
FIGS. 8 and 9 are partial longitudinal cross-sectional views of the third embodiment of the invention with its bolt in first and second positions, respectively.
Figure 9:
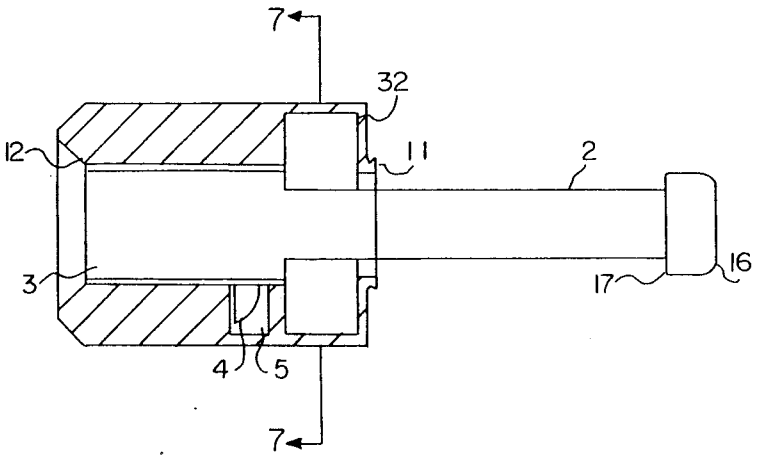
Figure 7:
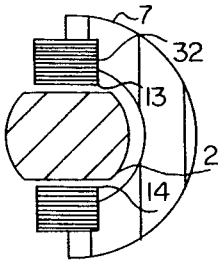
FIG. 7 is a partial cross-sectional view of a third embodiment of the invention taken along the lines 7—7 in FIGS. 8 and 9.

The third embodiment of the pin lock 1 is shown in FIGS. 7–9, and is similar to the second embodiment, except for the means for limiting the longitudinal movement of the bolt 2 in the bore 6 beyond the unlocked position. Shown in FIGS. 8 and 9 are a stopping member 16 which is attached to the end of the bolt 2 and prevents movement of the bolt 2 in bore 6 beyond the fully extended unlocked position, shown in FIG. 8. The stopping member 16 has a face 17 which contacts the sides of protrusions 32, thereby limiting the movement of the bolt 2. FIG. 9 shows the pin lock 1 in a locked position. Unlike the first and second embodiments, no recessed groove 8 or pin 9 are provided or are necessary.

Figure 11:
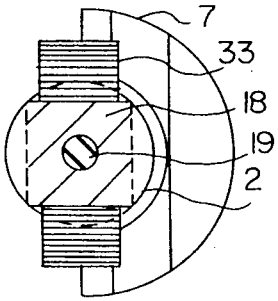
FIG. 11 is a full cross-sectional view of the fourth embodiment of the invention taken along the line 11—11 in FIG. 13.
Figure 13:
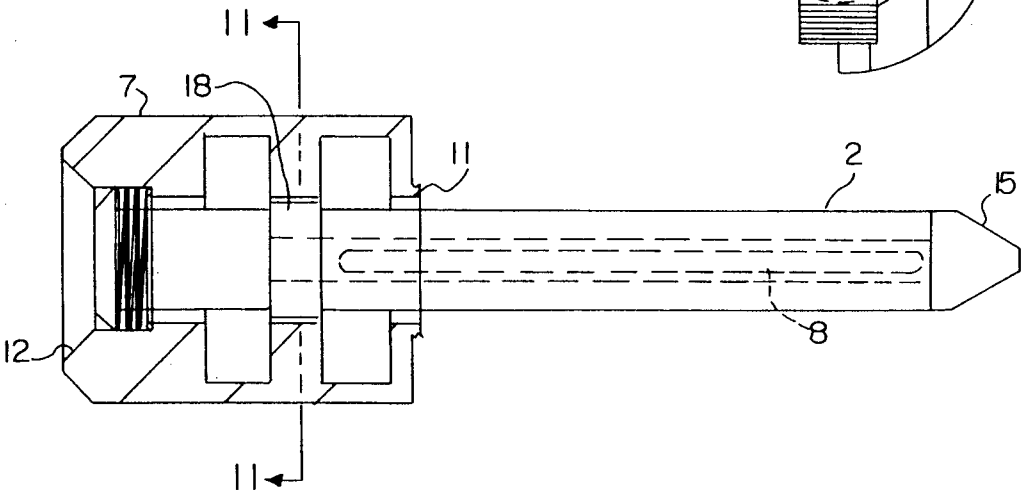
FIGS. 12 and 13 are partial longitudinal cross-sectional views of the fourth embodiment of the invention with its bolt in first and second positions, respectively.
Figure 12:
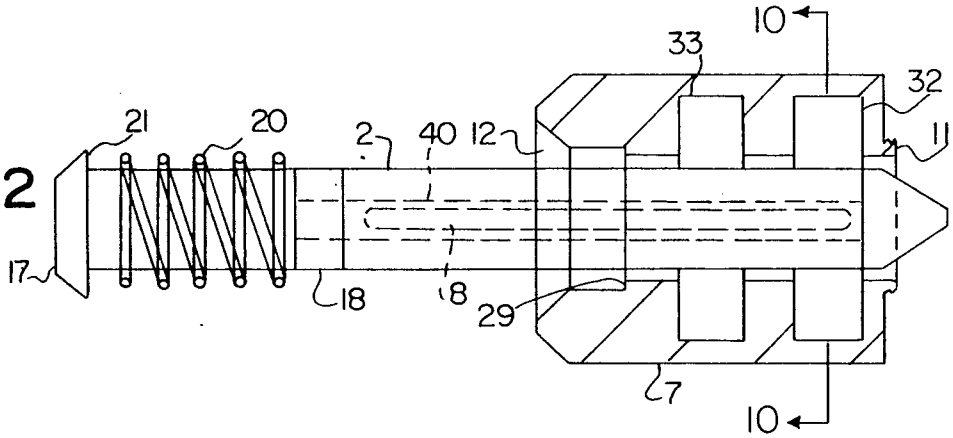
Figure 10:
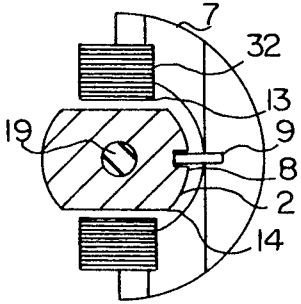
FIG. 10 is a partial cross-sectional view of a fourth embodiment of the invention taken along the lines 10—10 in FIG. 12.
Figure 15:
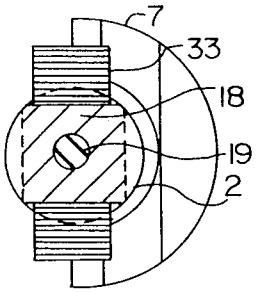
FIG. 15 is a full cross-sectional view of the fifth embodiment of the invention taken along line 15—15 in FIG. 17.

FIGS. 10–13 illustrate a fourth embodiment of the pin lock 1. Many features of the fourth embodiment are common to the second embodiment, and only the differences shall be pointed out. FIG. 10 is a partial cross-sectional view taken along the line 10—10 in FIG. 12. FIG. 11 is a full cross-sectional view through line 11—11 in FIG. 13. The cylinder lock 17 is different than the cylinder lock shown in FIGS. 1 through 9 and, although not shown, it has flat sides as does bolt 2. Instead of having a latch member which locks into an indentation in the bore, a locking member 18 which is fixedly attached to a shaft 19 which rotatably passes through a bore 40 in bolt 2. The shaft 19 is rigidly connected to the cylinder lock 17. The bolt 2 has a non-circular cross-section and the locking member 18 also has a non-circular cross-section. Two sets of protrusions 32 and 33 are provided inside of the bore 6. When the user of the bolt wishes to put the bolt in the locked position, the key mean (not shown) is turned which causes the shaft 19 and thus the locking member 18 to turn in relation to the bolt 2, and align the outer circumferences of the locking member 18 and the bolt 2, so that the bolt 2 and locking member 18 can be slid into the locked position. As can best be seen in FIGS. 11 and 13, in the locked position, the key means is turned which causes the locking member 18 to become orientated so that its outer circumference is not aligned with that of the bolt 2, thus allowing the locking member to become engaged between the protrusions 32 and 33 positioned longitudinally in the bore 6, and thus lock the bolt 2 in the locked position shown in FIG. 13. Protrusion 33 slideably engages with the flat sides of cylinder lock 17, thereby preventing the cylinder lock to rotate within bore 6. Protrusions 32 prevent bolt 2 from being rotated in bore 6. Although not shown, protrusions 32 and 33 may be spring loaded in the rigid body. Bore 6 is slightly enlarged 29 at the end closest to the cylinder lock 17 and a coil spring 20 is placed about and co-axial with the cylinder lock 17. The cylinder lock has a lip 21 which contacts one end of the coil spring 20 and the other end of the coil spring 20 contacts the bottom of the slightly enlarged bore 29. When the bolt 2 is put in the locked position, shown in FIG. 13, the coil spring 20 is compressed. When the pin lock 1 is unlocked, the coil spring 20 helps to push the bolt 2 out of the bore 6.

Figure 16:
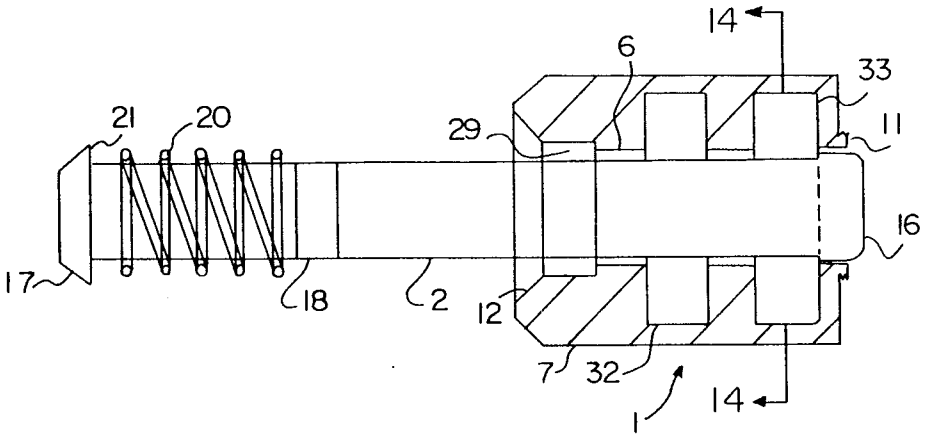
FIGS. 16 and 17 are partial longitudinal cross-sectional views of the fifth embodiment of the invention with its bolt in first and second positions, respectively.
Figure 17:
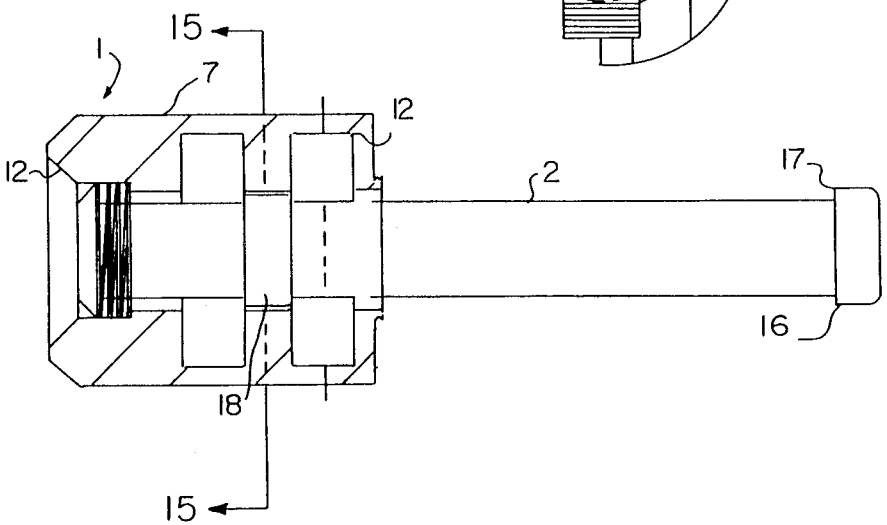
Figure 14:
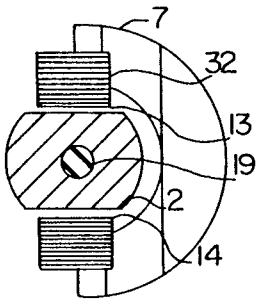
FIG. 14 is a partial cross-sectional view of a fifth embodiment of the invention taken along line 14—14 in FIG. 16.

The fifth embodiment of the pin lock is illustrated in FIGS. 14–17, and is similar to the fourth embodiment except for the means for limiting the longitudinal movement of the bolt 2 in the bore 6 beyond the unlocked position, shown in FIG. 16. Shown in FIGS. 16 and 17, both partial cross sectional views, are a stopping member 16 which is attached to the end of the shaft 19. The stopping member 16 has a face 17 which contacts the sides of protrusions 12, thereby limiting the movement of the bolt 2. FIG. 17 shows the pin lock 1 in a locked position. Unlike the fourth embodiment, no recessed groove 8 or pin 9 are provided or are necessary.

It should be borne in mind that the drawings are not rendered in actual scale so that certain features of the invention can be brought out and depicted.

The drawings and the foregoing description are not intended to represent the only form of the invention in regards to the detail of its construction and manner of operation. In fact, it will be evident to one skilled in the art that modifications and variations may be made without departing from the spirit and scope of the invention. Changes in form and in the proportion of parts, as well as the substitution of equivalents, are contemplated as circumstances may suggest or render expedient; and although specific terms have been employed, they are intended in a generic and descriptive sense only and not for the purpose of limitation, the scope of the invention being delineated in the following claims.

I claim:

1. A locking device for use for locking sliding curtain type doors, comprising:

a rigid body having a bore passing therethrough, at least a portion thereof having a non-circular cross section;

a bolt with a longitudinal axis having at least some portion thereof with a cross-section complementary to that of said non-circular portion of said bore, said bolt being at least partially slideably moveable within said bore between a first and second position, but prevented from rotating within said bore about its vertical axis, said bolt including a means for immobilizing said bolt relative to said rigid body in said second position, said immobilizing means comprising a cylinder lock connectably disposed with said bolt at one end thereof, said cylinder lock having a key activated tumbler coupled to a latch member, said latch member extending laterally of the longitudinal axis of said bolt and being spring loaded in said cylinder lock, said latch member having a beveled edge which faces said rigid body when said bolt is in said first position, a key means for activating said tumbler and means for releasing said key means from said tumbler of said cylinder lock only when said latch member is fully extended from said lock cylinder, and an indentation defined in said rigid body, on the inner surface of said bore, said indentation positioned to receive said latch member when said bolt is in said second position; and limiting means to prevent said bolt from being longitudinally moved in said bore beyond said first position, said limiting means comprising at least one longitudinally recessed groove on said bolt terminating at a distance from one end of said bolt, and a pin extending from said rigid body and slideably received in said recessed groove, thereby preventing complete withdrawal of said bolt from said bore.

2. A locking device as claimed in claim 1, wherein said bore is beveled at its end closest to said cylinder lock.

3. A locking device as claimed in claim 1, wherein said bolt is beveled at its end opposite the end having said cylinder lock.

4. A locking device as claimed in claim 1, wherein said rigid body has a raised shoulder located on the end of said rigid body opposite the end of said bore closest to said cylinder lock, said raised shoulder surrounding the corresponding end of said bore.

5. A locking device as claimed in claim 4, wherein said raised shoulder is threaded for purposes of rigidly connecting said locking device to a frame of a sliding curtain type door to be locked.

6. A locking device as claimed in claim 1 wherein said pin slideably received in said recessed groove is removable from said rigid body.

7. A locking device for use for locking sliding curtain type doors, comprising:

a rigid body having a bore passing therethrough, said bore having at least one protrusion located therein;

a bolt with a longitudinal axis having a longitudinal facial surface extending along at least a portion thereof, said at least one protrusion having an inwardly directed surface slideably engageable with said facial surface of said bolt to prevent said bolt to be rotated in said bore about its vertical axis, said bolt being at least partially slideably moveable within said bore between a first and second position, said bolt including a means for immobilizing said bolt relative to said rigid body in said second position, said immobilizing means comprising a cylinder lock connectably disposed with said bolt at one end thereof, said cylinder lock having a key activated tumbler coupled to a latch member, said latch member extending laterally of the longitudinal axis of said bolt and being spring loaded in said cylinder lock, said latch member having a beveled edge which faces said rigid body when said bolt is in said first position, a key means for activating said tumbler and means for releasing said key means from said tumbler of said cylinder lock only when said latch member is fully extended from said lock cylinder, and an indentation defined in said rigid body on the inner surface of said bore, said indentation positioned to receive said latch member when said bolt is in said second position; and limiting means to prevent said bolt from being longitudinally moved in said bore beyond said first position, said limiting means comprising at least one longitudinally recessed groove on said bolt terminating at a distance from one end of said bolt, and a pin extending from said rigid body and slideably received in said recessed groove, thereby preventing complete withdrawal of said bolt from said bore.

8. A locking device as claimed in claim 7, wherein said bore is beveled at its end closest to said cylinder lock.

9. A locking device as claimed in claim 7, wherein said bolt is beveled at its end opposite the end having said cylinder lock.

10. A locking device as claimed in claim 7, wherein said rigid body has a raised shoulder located on the end of said rigid body opposite the end of said bore closest to said cylinder lock, said raised shoulder surrounding the corresponding end of said bore.

11. A locking device as claimed in claim 10, wherein said raised shoulder is threaded for purposes of rigidly connecting said locking device to a frame of a sliding curtain type door to be locked.

12. A locking device as claimed in claim 7 wherein said pin slideably received in said recessed groove is removable from said rigid body.

* * * * *